US012624690B2

(12) United States Patent
Park

(10) Patent No.: US 12,624,690 B2
(45) Date of Patent: May 12, 2026

(54) LONG-LIFE NON-CONTACT PUMP

(71) Applicant: Myoung Chul Park, Hwaseong-si (KR)

(72) Inventor: Myoung Chul Park, Hwaseong-si (KR)

( * ) Notice: Subject to any disclaimer, the term of this patent is extended or adjusted under 35 U.S.C. 154(b) by 115 days.

(21) Appl. No.: 18/274,149

(22) PCT Filed: Dec. 20, 2021

(86) PCT No.: PCT/KR2021/019382
§ 371 (c)(1),
(2) Date: Oct. 2, 2024

(87) PCT Pub. No.: WO2022/164034
PCT Pub. Date: Aug. 4, 2022

(65) Prior Publication Data

US 2025/0283458 A1 Sep. 11, 2025

(30) Foreign Application Priority Data

Jan. 28, 2021 (KR) ..... 10-2021-0012467

(51) Int. Cl.
*F04B 43/00* (2006.01)
*F04B 39/04* (2006.01)
(Continued)

(52) U.S. Cl.
CPC ..... *F04B 43/0072* (2013.01); *F04B 43/107* (2013.01); *F04B 39/042* (2013.01);
(Continued)

(58) Field of Classification Search
CPC combination set(s) only.
See application file for complete search history.

(56) References Cited

U.S. PATENT DOCUMENTS 5,228,473 A * 7/1993 Zink ..... F04B 43/10 137/565.14
8,025,488 B2 9/2011 Sellas et al.
8,133,042 B2 * 3/2012 Yajima ..... F04B 43/084 417/431
2007/0177998 A1 * 8/2007 Kato ..... F04B 43/0081 417/540
(Continued)

FOREIGN PATENT DOCUMENTS

DE 1 653 445 A1 7/1971
EP 3 168 550 B1 2/2020
(Continued)

OTHER PUBLICATIONS

International Search Report and Written Opinion in International Application No. PCT/KR2021/019382 dated Mar. 18, 2022, 11 pages (with English translation).
(Continued)

*Primary Examiner* — Binh Q Tran
(74) *Attorney, Agent, or Firm* — Crowell & Moring LLP

(57) ABSTRACT

The inventive concept provides long-life non-contact pump including a pump cylinder having a certain pumping space, an inlet valve and an outlet valve respectively located at a part of the pump cylinder to prevent backflow of a fluid and to allow the fluid to flow in and out, a bellows provided in the pumping space of the pump cylinder and varying a volume of the pumping space to pump the fluid flowing in/out along the inlet and outlet, and a reciprocating drive unit provided on the outside of the cylinder cover to cause a reciprocating driving of the piston along the connected reciprocating rod. Accordingly, airtightness in a pumping operation without friction between parts may be maintained, the generation of foreign substances in the fluid due to friction may be prevented, and the replacement life of consumables may be improved.

5 Claims, 4 Drawing Sheets

(51) Int. Cl.
*F04B 43/107* (2006.01)
*F04B 45/02* (2006.01)

(52) U.S. Cl.
CPC ..... *F04B 39/047* (2013.01); *F04B 45/02* (2013.01); *F04B 2205/10* (2013.01); *F04B 2205/11* (2013.01)

(56) References Cited

U.S. PATENT DOCUMENTS

| | | | | |
|---|---|---|---|---|
| 2009/0165640 | A1* | 7/2009 | Kawasaki | F04B 45/02 91/169 |
| 2013/0165847 | A1* | 6/2013 | Scarpaci | A61M 1/28 417/478 |
| 2014/0109973 | A1* | 4/2014 | Neumeister | C23C 16/4412 137/1 |
| 2016/0298621 | A1* | 10/2016 | Niethammer | F04B 9/045 |
| 2022/0275798 | A1* | 9/2022 | Gebauer | F16K 15/148 |

FOREIGN PATENT DOCUMENTS

| | | | |
|---|---|---|---|
| FR | 2 898 942 | B1 | 5/2008 |
| JP | 58-162384 | U | 10/1983 |
| JP | S62-186077 | A | 8/1987 |
| JP | H11-214489 | A | 8/1999 |
| JP | 2000-015168 | A | 1/2000 |
| JP | 2005-155676 | A | 6/2005 |
| JP | S49-13526 | B2 | 4/2012 |
| KR | 10-2013-0077824 | A | 7/2013 |
| KR | 10-1501264 | B1 | 3/2015 |
| KR | 10-2017-0016059 | A | 2/2017 |
| KR | 10-2321443 | B1 | 11/2021 |
| WO | WO 2011/137145 | A1 | 11/2011 |
| WO | WO 2016/006648 | A1 | 1/2016 |

OTHER PUBLICATIONS

Office Action in Korean Application No. 10-2021-0012467 dated Jun. 25, 2021, 9 pages (with English translation).
Notice of Allowance in Korean Application No. 10-2021-0012467 dated Oct. 26, 2021, 4 pages (with English translation).
Extended European Search Report issued in European Application No. 21923440.8 dated Nov. 29, 2024 (9 pages).
Japanese-language Search Report issued in Japanese Application No. 2023-545958 dated Jun. 12, 2024, with English translation (12 pages).

* cited by examiner

LONG-LIFE NON-CONTACT PUMP

TECHNICAL FIELD

The disclosure relates to a non-contact pump, and more particularly, to a long-life non-contact pump capable of maintaining airtightness during a pumping operation without friction between parts, preventing the generation of foreign substances in a fluid due to friction, having improved lifespan and reducing replacement costs for consumables, increasing the operation rate of equipment, allowing replacement of consumables more easily, and capable of being applied in various industrial fields.

BACKGROUND ART

In general, as shown in FIG. 1, a piston reciprocating pump includes an inlet valve 1 for preventing backflow of a fluid at an inlet through which the fluid enters the pump; an outlet valve 2 for preventing backflow of the fluid from the outlet through which the fluid is discharged from the inside of the pump; a pump cylinder 3 having a space for accommodating the fluid inside the pump; a piston 4 that expands and contracts a space so that the fluid may enter and exit the pump cylinder 3; a sealing member 5 for sealing the pump cylinder 3 so that the fluid does not leak between the pump cylinder 3 and the piston 4; a sealing guide 6, a fluid injection container 7 for injecting a fluid to reduce wear of the sealing member 5; and a pumping drive unit 8 in which the piston 4 performs a reciprocating motion.

The piston reciprocating pump has a structure such that when a volume inside the pump cylinder 3 increases, a corresponding fluid enters the pump through the inlet valve 1, and when the volume inside the pump cylinder 3 decreases, the corresponding fluid is discharged to the outside of the piston reciprocating pump through the outlet valve 2.

In the case of an existing piston reciprocating pump, a material used for sealing is worn out by the reciprocating motion and friction between the piston 4 and the pump cylinder 3, and thus, the material should be replaced with a consumable after a certain number of operations.

Therefore, as the production capacity of equipment improves and the number of operations increases, the replacement cycle of related consumables is gradually shortened. Depending on the production capacity of the equipment, consumables are replaced once every 1 to 2 weeks on some production lines.

In other words, like the structure of a piston reciprocating pump, in a structure in which a gap between the pump cylinder 3 and the piston 4 is sealed so as not to allow the fluid to leak and the piston 4 reciprocates while rubbing the sealing member 5, it is necessary to make a surface where the piston 4 rubs the sealing member 5 more smooth or increase the replacement cycle of consumables by selecting a material with less frictional force and wear for the sealing member 5.

However, processing a contact surface and changing the sealing member 5 may have limitations in increasing the lifespan of consumables to several times or more in a structure in which materials undergo a friction operation.

In addition, as the replacement period is shortened, the frequency of replacing consumables by workers by stopping the equipment increases, which results in loss for a manufacturer, such as the increase in consumables costs, equipment downtime, and labor costs.

In addition, when consumables are replaced, there are many replacement works and parts to be replaced such as disassembling and lubricant injection into the sealing member 5, the sealing guide 6, and the fluid injection container 7, and in assembling the sealing member 5 and the sealing guide 6, if the sealing member 5 is damaged or not tightly assembled in a correct position, because the skills of workers are different from each other, there may a problem in that easiness of replacement work and maintenance may not be achieved.

In particular, Korean Registered Patent Publication No. 10-1449047 discloses that, in using a bellows material as a resin material, in order to prevent severe deformation of the bellows due to external pressure, the bellows includes an incompressible indirect medium including a fluid such as oil to maintain the pressure in the bellows.

That is, in using a resin-based fluid in a structure for pumping a small amount of fluid, deformation occurs when the fluid is compressed, and an incompressible medium must be filled for 48 hours to compensate for the deformation.

In addition, in order to apply an incompressible indirect medium inside the bellows, a configuration of a complicated structure is required, and thus, the manufacturing costs and product prices increase.

In addition, in a piston reciprocating pump, foreign substances may be generated due to friction of the sealing materials during the reciprocating operation, and there is a drawback in that the foreign substances may flow into the fluid. Thus, the piston reciprocating pump may have an improper structure for pumping fluids such as medical fluids or chemical fluids and maintain the purity thereof.

Therefore, due to the improvement of production capacity of the existing battery manufacturing process, the replacement cycle of consumables in related equipment is shortened, the cycles of stopping the operation of equipment and replacing consumables are shortened, and thus, equipment for addressing these problems is required.

DISCLOSURE

Technical Problem

In order to solve the above problems, the disclosure provides a long-life non-contact pump having a pump structure in which a bellows is applied, the long-life non-contact pump may maintain airtightness during pumping operations without friction between parts, prevent generation of foreign substances in a fluid by friction, reduce replacement costs by improving the lifespan of consumables, increase the operation rate of equipment, and replace consumables more easily than before, and may be applied to various industrial fields.

Technical Solution

According to an aspect of the disclosure, a long-life non-contact pump includes a pump cylinder having a certain pumping space for accommodating introduced fluid and intaking/discharging the fluid through a pumping operation along an inlet and an outlet formed on both sides thereof, the pump cylinder including an outlet valve that is provided on an outlet side and prevents backflow of the fluid when the fluid flows in along the inlet and an inlet valve that is provided on an inlet side and prevents backflow of the fluid when the fluid is discharged along the outlet, a bellows provided in the pumping space of the pump cylinder and varying a volume of the pumping space so as to pump the fluid flowing in/out along the inlet and outlet, a piston that closes one end of the bellows and moves together with the bellows, a reciprocating rod that is integrally connected to the piston and extends outward of the pump cylinder to expand and contract the bellows by reciprocally driving together with the movement of the piston, a cylinder cover that closes a part of the pump cylinder, and fixes the other end of the bellows, and through which the reciprocating rod passes, and a reciprocating drive unit provided on the outside of the cylinder cover to drive the piston reciprocally along the connected reciprocating rod.

Here, the bellows may include a first bellows pipe including rubber and having a vacuum space therein, a volume of which is variable to be expendable and contractable, and a second bellows pipe formed on the outside of the first bellows pipe and including a thin metal plate so that the rigidity of the first bellows pipe is maintained against repeated volume changes.

The cylinder cover may further include a vacuum line for forming a vacuum in the vacuum space formed inside the bellows.

The drain hole of the cylinder cover may further include a leak sensor coupled to the drain hole and configured to detect fluid entering the vacuum space when the bellows is damaged, to confirm the fluid entering the vacuum space from the outside, and to remove the entering fluid.

The long-life non-contact pump may further include, on a part of the pump cylinder, a temperature sensor configured to sense the temperature of the fluid flowing in/out of the pumping space by the pumping of the bellows.

The long-life non-contact pump may further include, on one part of the pump cylinder, a temperature sensor configured to sense the temperature of the fluid flowing in/out of the pumping space by the pumping of the bellows.

Advantageous Effects

The long-life non-contact pump having the configuration described above may have the following advantages.

First, in a pumping operation, there is an effect of improving the consumable replacement cycle by improving the structure of compression/expansion pumping operation using a metal bellows without friction between parts that maintain airtightness, so that the replacement cycle of consumables that are replaced every week or after several weeks in an existing pump is increased to few months.

Second, there is an effect of solving inconveniences by increasing the existing short consumable replacement cycle, reducing costs of loss due to consumable replacement, and increasing the operating rate of the pump.

Third, the number of consumables to be replaced is less compared to the existing pump, and the replacement method is simple and easy.

Fourth, the long-life non-contact pump may be readily applied to various industrial fields such as semiconductors, displays, and chemicals other than the battery manufacturing industry.

BEST MODE

Figure 1:
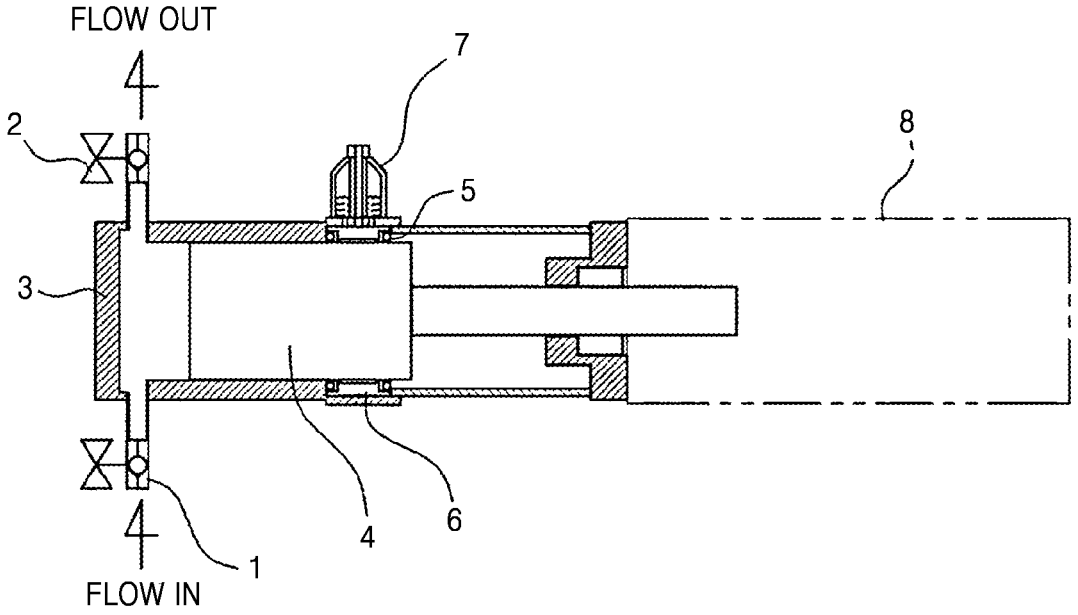
FIG. 1 is a diagram showing a piston reciprocating pump of the related art.

Specific aspects and specific technical features of the inventive concept become more apparent from the following detailed description and examples taken in conjunction with the accompanying drawings. In the specification, in giving reference numerals to components of each drawing, it should be noted that like components have like numerals as much as possible even if they are displayed on different drawings.

In addition, in describing the embodiments of the inventive concept, when practical descriptions with respect to related known functions and configurations may unnecessarily make the scope of the inventive concept unclear, the descriptions thereof are omitted.

In addition, in describing the components of the inventive concept, terms are only used to distinguish one component from another component, and the nature, order, or order of the component are not limited by the terms. When a component is described as being "connected", "coupled" or "connected" to another component, the component may be directly connected or connected to that other component, but another component between each component It should be understood that elements may be "connected", "coupled" or "connected".

Hereinafter, an embodiment of the inventive concept will be described in detail with reference to the accompanying drawings.

Figure 2:
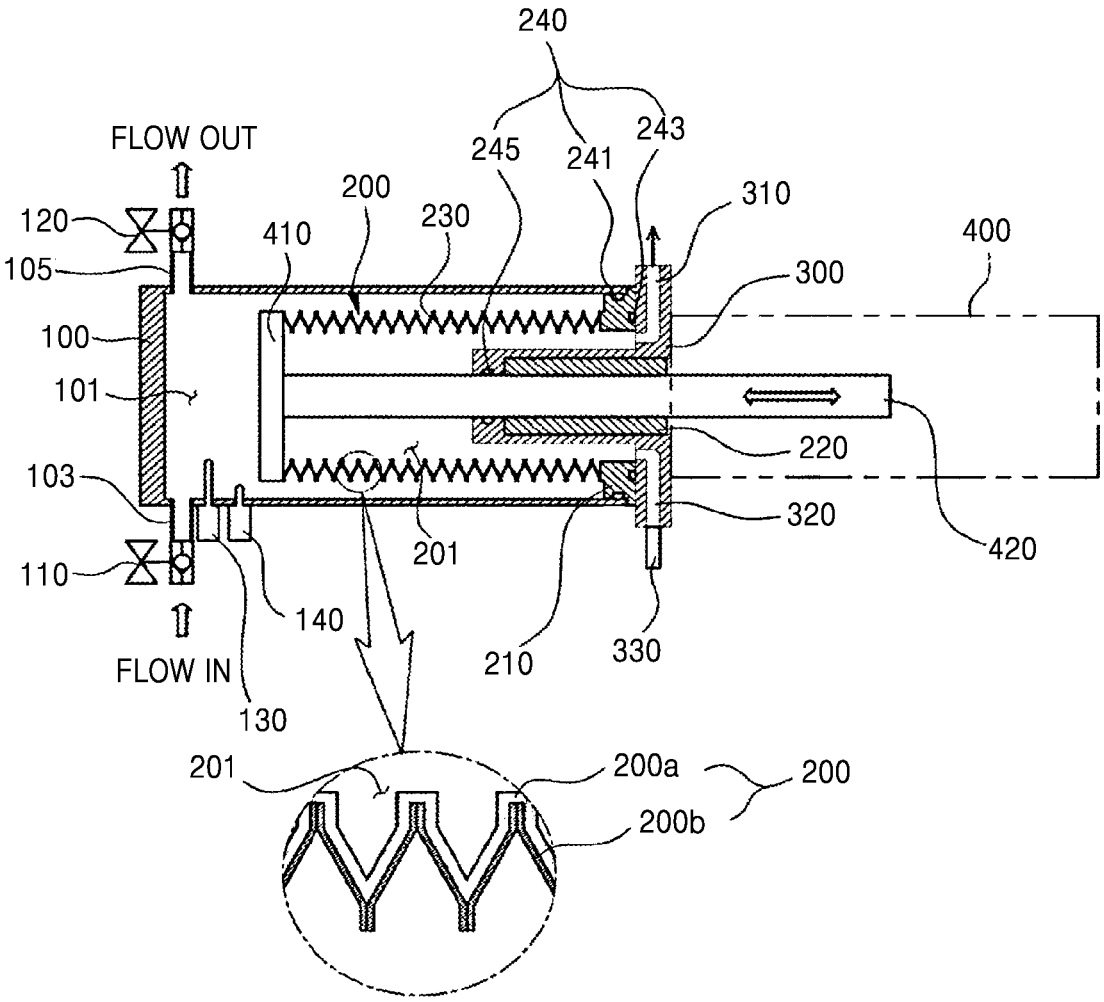
FIGS. 2 to 4 are diagrams showing configurations and operating states of a long-life non-contact pump according to an embodiment.
Figure 3:
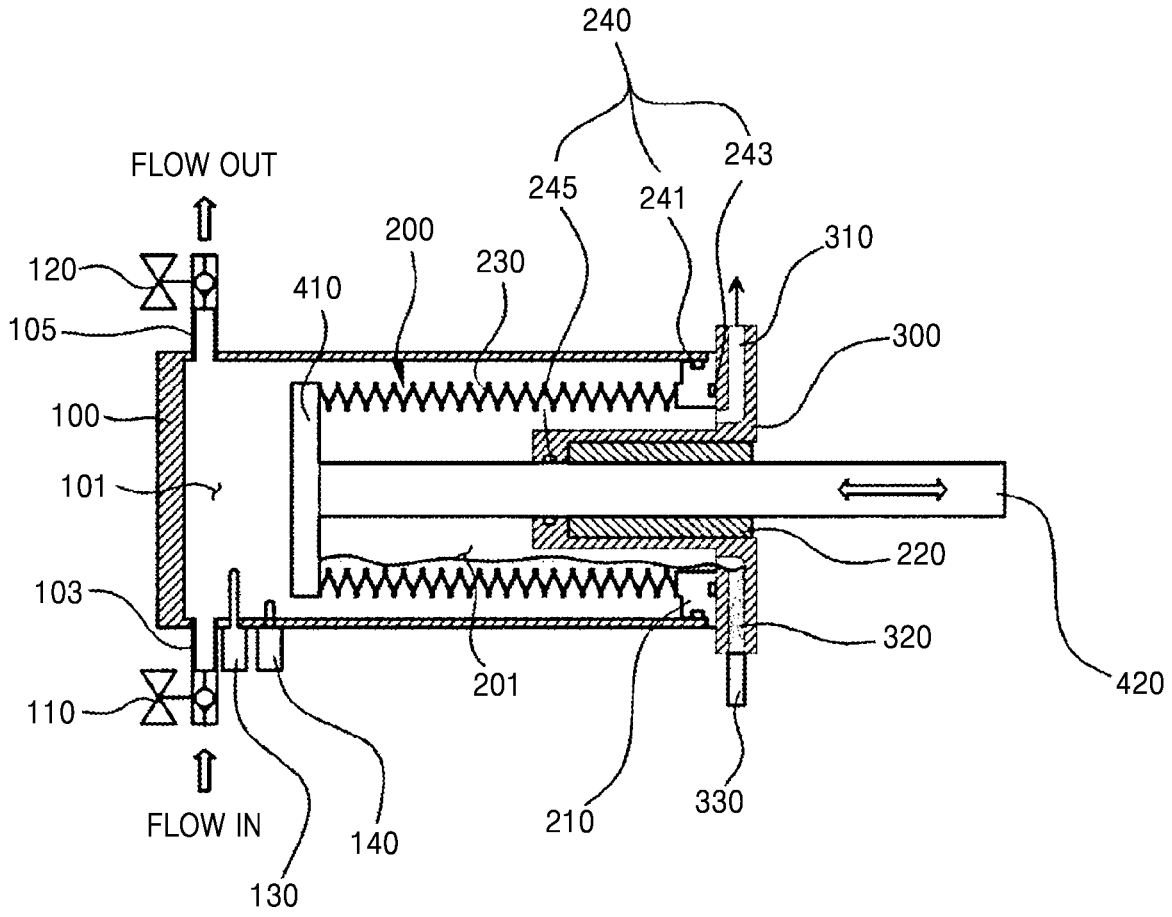
Figure 4:
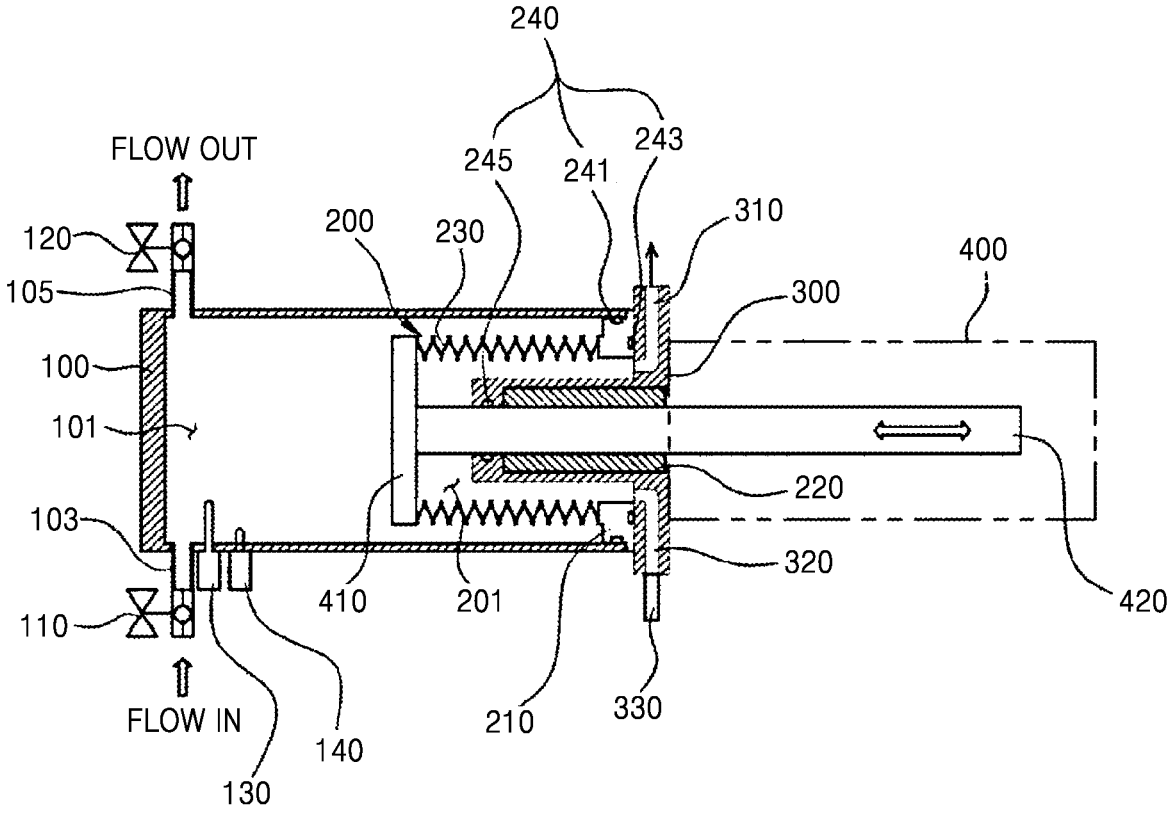

As shown in FIGS. 2 to 4, a long-life non-contact pump of the inventive concept may be configured by including a pump cylinder 100 configured to inject fluid (electrolyte or battery liquid) into a battery, a bellows 200 provided inside the pump cylinder 100 and configured to perform a pumping operation through compression and expansion, a reciprocating drive unit 400 configured to control the pumping operation of the bellows 200, and a cylinder cover 300 that closes the pump cylinder 100 and the bellows 200 to prevent leakage of the battery liquid.

The pump cylinder 100 includes, on both sides thereof, an inlet 103 having an inlet valve 110 for introducing fluid and preventing backflow of the fluid, and an outlet 105 having an outlet valve 120 for discharging the fluid and preventing backflow of the fluid, and has a predetermined pumping space 101 in which the fluid is accommodated.

In other words, the pump cylinder 100 intakes/discharges fluid through the pumping operation along the inlet 103 and the outlet 105 formed on both sides thereof, includes the outlet valve 120 that is provided in the outlet 105 to prevent backflow of the discharging fluid when the fluid flows in through the inlet 103 and the inlet valve 110 that is provided in the inlet 103 to prevent the flow of fluid into the cylinder when the fluid is discharged through the outlet 105, and the predetermined pumping space 101 in which the introduced fluid is accommodated.

In addition, the bellows 200 is provided in the predetermined pumping space 101 of the pump cylinder 100 to vary a volume of the predetermined pumping space 101 so that fluid is pumped to flow in/out through the inlet 103 and the outlet 105.

That is, the bellows 200 may include a first bellows pipe 200*a* including rubber and having a vacuum space 201 therein, a volume of which is variable, that is, expendable and contractable, and a second bellows pipe 200*b* formed on the outside of the first bellows pipe 200*a* by including a thin metal plate so that the rigidity of the first bellows pipe 200*a* is maintained against repeated volume changes.

On the other hand, although the second bellows pipe 200*b* includes a metal, if the second bellows pipe 200*b* may be replaced with a material having the same elasticity and airtightness as the first bellows pipe 200*a*, the bellows 200 may only be configured with the second bellows pipe 200*b*.

At this time, in order to minimize stress caused by sufficient volume change and repetitive operation of the pumping space 101, the second bellows pipe 200*b* to which a thin metal plate welding bellows is applied may increase the effect of the sufficient volume of fluid and the repeated lifespan.

At this time, the bellows 200 may include the second bellows pipe 200*b* that is stretchable and provided in the pumping space 101, a piston 410 closing one end of the second bellows pipe 200*b*, and a fixing flange 210 fixed to an inside of the cylinder cover 300 at the same time as closing the other end of the second bellows pipe 200*b*.

That is, the piston 410 may move together with the bellows 200 by closing the one end of the bellows 200.

In addition, a reciprocating rod 420 is integrally connected to the piston 410 and extends outward of the pump cylinder 100, and thus, may vary the volume of the bellows 200 through reciprocating movement along with the moving of the piston 410.

The cylinder cover 300 may be configured to close a part of the pump cylinder 100, to fix the other end of the bellows 200, and to pass the reciprocating rod 420 therethrough.

At this time, the cylinder cover 300 may further include a vacuum line 310 for forming a vacuum in the vacuum space 201 formed inside the bellows 200.

In addition, the reciprocating drive unit 400 is provided outside the cylinder cover 300 to reciprocally drive the piston 410 along the connected reciprocating rod 420.

On the other hand, the reciprocating rod 420 is connected between the piston 410 of the bellows 200 and the reciprocating driving unit 400, and one end of the reciprocating rod 420 is fixed on the piston 410 of the bellows 200 to vary the volume of the bellows 200.

Then, the reciprocating drive unit 400 is coupled to the outside of the cylinder cover 300, and may reciprocally drive the piston 410 by connecting the reciprocating rod 420.

A temperature sensor 130 that detects a temperature of fluid flowing in/out of the pumping space 101 may be included in one portion of the pump cylinder 100.

Finally, a pressure sensor 140 that senses pressure of the fluid flowing in/out of the pumping space 101 may be included in one portion of the pump cylinder 100.

That is, the inlet 103 through which fluid enters the pumping space 101 of the pump cylinder 100 and the inlet valve 110 preventing backflow of the fluid in the inlet 103 are provided on one side of the pump cylinder 100, and the outlet 105 through which fluid is discharged from the pumping space 101 of the pump cylinder 100 and the outlet valve 120 preventing backflow of fluid into the outlet 105 are formed on the other side of the pump cylinder 100, and thus, fluid may be continuously pumped and supplied to a battery.

The volume stretchable bellows 200 is provided so that fluid flows in/out of the pumping space 101 of the pump cylinder 100, and to form a vacuum in the vacuum space 201 of the bellows 200, the vacuum line 310 connecting an inside of the bellows 200 to the outside of the cylinder cover 300 with a hole of a certain size is formed.

At the center of the cylinder cover 300, a rod guide 220 that is coupled to the reciprocating rod 420 by a bushing and guides precise reciprocating of the reciprocating rod 420 during a pumping operation of the bellows 200 may further be provided.

Here, the reciprocating rod 420 fixed to the piston 410 of the bellows 200 and reciprocally driven for expansion/contraction of the bellows 200 is sequentially configured, and the rod guide 220 that guides the reciprocating rod 420 to be able to reciprocate precisely is provided at the center of the cylinder cover 300.

In the case when the bellows 200 is damaged due to the end of its service life, in order to detect fluid leaking into the vacuum space 201 of the bellows 200, a leak sensor 330 may further be provided.

Here, the leak sensor 330 may be provided in the drain hole 320 of the cylinder cover 300 to remove fluid in the vacuum space 201 according to a detection signal of the leak sensor 330 by closing the drain hole 320 that discharges fluid entering the vacuum space 201 when the bellows 200 is damaged.

When the temperature of fluid to be pumped is changed, a discharge volume of the fluid is changed due to the change in the density of the fluid, and thus, the temperature sensor 130 may give an alarm by sensing the temperature or correct the volume change.

The pressure sensor 140 may measure and manage pressure of fluid in the pump cylinder 100 when intaking and discharging the fluid and manage optimal pumping conditions during intake and discharge of the fluid.

The present inventive concept may further propose a sealing member 240 that couples the bellows 200, the rod guide 220, and the reciprocating drive unit 400, and that assembles the pump cylinder 100, the bellows 200, and the cylinder cover 300 for airtightness.

Here, the sealing member 240 may include a first sealing 241 provided between the pump cylinder 100 and a fixed flange 210, a second sealing 243 provided between the fixed flange 210 and the cylinder cover 300, and a third sealing 245 provided between the cylinder cover 300 and the reciprocating rod 420.

The long-life non-contact pump of the inventive concept configured as described above has a structure and connection relationship as follows.

First, the pumping space 101 between the pump cylinder 100 and the bellows 200 is filled with a fluid.

Therefore, the fluid enters an inside of the pump cylinder 100 through the inlet valve 110 and is discharged through the outlet valve 120, and the bellows 200 may pump the corresponding fluid.

Here, the inlet valve 110 and the outlet valve 120 may each include a check valve built therein to prevent backflow of fluid.

Between the pump cylinder 100 and the bellows 200 and between the cylinder cover 300, airtightness of coupled parts is maintained by the sealing member 240, thereby preventing leakage of fluid.

The vacuum line 310 is connected to the vacuum space 201 of the bellows 200 to maintain a constant vacuum state, and when the reciprocating rod 420 is in a forward position by the driving of the reciprocating drive unit 400, the piston 410 locates in side directions of the inlet valve 110 and the outlet valve 120.

At this time, in a state when the piston 410 of the bellows 200 is maximally advanced, the bellows 200 is maximally extended, and thus, the pumping space 101 of the pump cylinder 100 has a minimum volume.

On the other hand, in a stand-by state before fluid flows in, when the reciprocating rod 420 is driven backward by the reciprocating drive unit 400, the piston 410 of the bellows 200 starts a backward driving in a direction away from the inlet valve 110 and the outlet valve 120, and then, fluid flows into the pump cylinder 100 by opening the inlet valve 110.

When the backward driving is completed, when closing the inlet valve 110, the piston 410 of the bellows 200 is in a state of minimal backward motion, and the pumping space 101 of the pump cylinder 100 forms a maximum volumetric space in a state when a volume of the bellows 200 is reduced to the minimum.

On the other hand, in a state when the fluid intake operation is completed, when the reciprocating rod 420 moves forward by the reciprocating drive unit 400 in a standby state before fluid discharge, the piston 410 of the bellows 200 moves forward in a direction close to the inlet valve 110 and the outlet valve 120, and when the forward movement starts, the outlet valve 120 is opened and the fluid is discharged from the pumping space 101 of the pump cylinder 100 through the outlet valve 120.

At this time, when the forward movement is completed, the outlet valve 120 maintains a closed state and returns (to the closed state?) after the discharge of fluid is completed.

The long-life non-contact pump of the inventive concept may pump the corresponding fluid by repeating a standby state before fluid discharge and a standby state before fluid introduction by the driving of the reciprocating drive unit 400.

On the other hand, in the case of the vacuum space 201 of the bellows 200, the leak sensor 330, one side thereof is sealed, is installed on a lower part of the cylinder cover 300 to maintain a vacuum state of the vacuum space 201.

The thin metal plate of the bellows 200 may undergo accumulation of fatigue while the bellows 200 repeats an expansion/contraction variable operation.

At this time, when the service life of the thin metal plate of the bellows 200 is over due to the accumulation of fatigue, gaps may be generated where the thin metal plate is welded or where fatigue is accumulated, and even if fluid leaks into the vacuum state pumping space 101 of the pump cylinder 100, when a small amount of fluid starts leaking due to beginning of crack generation in the thin metal plate of the bellows 200, the fluid starts to fill a lower part of the vacuum space 201 of the bellows 200, and the drain hole 320 is filled with the fluid.

On the other hand, when the drain hole 320 is filled with fluid, even if gaps are generated in the bellows 200, the leak sensor 330 may check, give an alarm to the equipment, and thus, damage to the equipment due to the damage of the bellows 200 may be prevented, and at the same time, the replacement time of consumables may be informed.

A discharging quantity of fluid may be determined by a volume change of the pumping space 101 of the pump cylinder 100 at a forward position and a backward position of the bellows 200, and thus, the supply amount may be determined.

On the other hand, it may be confirmed that a discharge weight of the fluid changes on the basis of the same volume as the density of the fluid changes as the temperature of the fluid changes, and if the volume of fluid is corrected as much as the weight of the volume change due to the density change according to temperature condition changes or if there is an alarm setting function for the temperature change, the quality of the product manufactured by using the long-life non-contact pump may increase.

In addition, the temperature sensor 130 configured to measure a temperature of fluid in the pumping space 101 of the pump cylinder 100 is included in the long-life non-contact pump to compensate and control a reciprocating driving amount of the bellows 200 by measuring the temperature of the fluid filled in the pumping space 101 and calculating the volume change according to the temperature change, and thus, a dangerous situation may be identified by detecting the temperature change of the equipment.

The pressure sensor 140 may measure and manage pressure at the time of intake and discharge the internal fluid of the pump cylinder 100 to manage an optimal pumping condition during intake and discharge fluid.

In other words, the pressure sensor 140 may confirm whether the amount of fluid flowing into the pump is constant or not by checking whether the intake/discharge pressure is constant at each discharge, and check whether the inlet valve 110 and the outlet valve 120, that perform a role of preventing backflow in the inlet 103 and the outlet 105 through which fluid is introduced and discharged, are properly operated or not.

Therefore, it is possible to pump an accurate amount of fluid by maintaining a constant pressure at each intake or discharge, and when the intake and discharge pressures change, a situation in which the amount of introduced and discharged fluid is changed or each check valve of the inlet 103 and the outlet 105 needs to be inspected may be notified.

In the case of the long-life non-contact pump of the inventive concept, in a fluid pumping operation for supplying fluid to a battery, in order to prevent wear caused by contact and friction, which is a problem for the service life of existing pumps, it is possible to extend the lifetime of consumables by developing a structure to which the bellows 200 may be applied.

Therefore, the design life of the bellows 200 is about millions of cycles, and the effect of improving the lifespan is more than 10 times greater than before, and the production capacity of the production line for injecting fluid into the battery may be extended by 6 to 12 months more than before.

Therefore, in order to minimize the deformation of the bellows 200 when the bellows 200 is a stretched or stopped state, when the pressure in the vacuum space 201 of the bellows 200 is the same as the external pressure by performing a vacuuming process, sagging at the central part of the bellows 200 due to its own weight when the bellows 200 is horizontally installed or vibration of the bellows 200 due to the reciprocating motion of the bellows 200 may be minimized.

On the other hand, by maintaining a vacuum condition in the vacuum space 201 of the bellows 200, the bellows 200 may have minimum deformation due to differential pressure with the outside, increase the precision of inflow/outflow of fluid through a shape, and control a more stable pumping amount.

In addition, the leak sensor 330 may prevent an equipment body from being damaged by a load even if the fluid leaks inside due to the damage of the bellows 200.

Therefore, by greatly improving the pumping structure by applying the bellows 200 to the long-life non-contact pump of the inventive concept and the structure in which the stretchable pumping operation using the bellows 200 without friction between parts that maintain airtightness, compared to the existing pumps, hundreds of thousands of consumable replacement cycles may be improved to millions of cycles, and consumables that currently need to be replaced every week or several weeks may be replaced after several months or more.

In addition, when replacing consumables, only one bellows 200 or a small number of parts need to be replaced, the replacement work may be relatively easy compared to the existing method, and thus, operators may easily learn how to replace consumables and replace them in a short time because the replacement method is simpler than in the existing pump and the number of replacement parts is small.

In the long-life non-contact pump of the inventive concept, when a small amount of fluid starts leaking due to crack generation begins in the thin metal plate of the bellows 200, the leak is immediately detected by the leak sensor 330, and thus, the replacement time may be known before the fluid leaks out of the pump, there is a great advantage in preventing a safety accident such as equipment contamination or fire accident.

Also, in addition to the fluid injection process for automobiles, the fluid pump may be applied to various industrial fields, such as semiconductors, displays, chemicals, pharmaceutical companies, etc. and effects may be expected, and the bellows 200 may be applied according to characteristics of each fluid by forming the bellows 200 using a material such as a resin-based or special material instead of a metal.

By providing the inventive concept configured as above descriptions, a manufacturing process requires a product having a longer replacement cycle of consumables, but a piston-operated pump may be used because there is no suitable product, and the replacement cycle of consumables may be greatly extended by using a structure of a different concept other than the contact-type airtightness, which is a disadvantage of piston pumps.

First, in pumping operations, the long-life non-contact pump has a structural feature wherein the stretchable pumping operation is performed using a bellows without friction between parts that maintain airtightness, and thus, as the number of pumping increases from hundreds of thousands to millions of times, the replacement cycle of consumables may further be extended than before.

Second, it is possible to cope with the replacement cycle of consumables that are currently replaced every few weeks may be replaced once every few months.

Third, it is possible to solve the inconvenience by supplementing the short consumable replacement cycle, greatly reduce the cost loss due to the replacement of consumables by the manufacturer and increase the operation rate of the equipment.

Fourth, when replacing consumables, only one bellows or a small number of parts need to be replaced, and the replacement work is relatively easy compared to the existing method, the number of parts to be replaced is small, and because the replacement method is simple compared to the existing pump, the operator may easily learn the replacement method and replace consumables in a short time.

The terms and words used in the present specification described above and claims should not be construed as being limited to conventional or dictionary meanings, and based on the principle that the present inventor may appropriately define the concept of terms in order to explain his/her invention in the best way, it should be interpreted as meaning and concept consistent with the technical spirit of the inventive concept.

Therefore, the configurations shown in the drawings and embodiments described in this specification are only one of the most preferred embodiments of the inventive concept, and do not represent all of the technical ideas of the inventive concept, and thus, it should be understood that there may be various equivalents and modifications that may be substituted for the inventive concept at the time of the application.

INDUSTRIAL APPLICABILITY

A pumping fluid using a long-life non-contact pump may be applied to various industrial fields, such as semiconductors, displays, chemicals, pharmaceutical companies, food, cosmetics, etc. and a better pumping effect may be expected, and the bellows 200 may be applied according to characteristics of each fluid by forming the bellows 200 using a material such as a resin-based or special material instead of a metal.

The invention claimed is:

1. A long-life non-contact pump comprising:

a pump cylinder having a certain pumping space for accommodating introduced fluid and receiving/discharging the fluid through a pumping operation via an inlet and an outlet formed on both sides thereof, the pump cylinder including an outlet valve that is provided on an outlet side and prevents backflow of the fluid when the fluid flows in along the inlet and an inlet valve that is provided on an inlet side and prevents backflow of the fluid when the fluid is discharged along the outlet;

a bellows provided in the pumping space of the pump cylinder and varying a volume of the pumping space so as to pump the fluid flowing in/out along the inlet and outlet;

a piston that closes one end of the bellows and moves together with the bellows;

a reciprocating rod that is integrally connected to the piston and extends outward of the pump cylinder to expand and contract the bellows by reciprocally driving together with a movement of the piston;

a cylinder cover that closes a part of the pump cylinder and fixes the other end of the bellows, and through which the reciprocating rod passes; and a reciprocating drive unit provided on the outside of the cylinder cover to drive the piston reciprocally along the connected reciprocating rod, wherein a vacuum space is formed, and vacuum is maintained inside the bellows in an expanded and contracted state through a vacuum line formed in the cylinder cover.

2. The long-life non-contact pump of claim 1, wherein the bellows includes:

a first bellows pipe including rubber and having a vacuum space therein, a volume of which is variable and capable of expending and contracting; and a second bellows pipe formed on the outside of the first bellows pipe and including a thin metal plate so that a rigidity of the first bellows pipe is maintained against repeated volume changes.

3. The long-life non-contact pump of claim 1, further comprising:

a drain hole for discharging the fluid entering the vacuum space in the cylinder cover; and a leak sensor coupled to the drain hole and configured to detect the fluid entering the vacuum space when the bellows is damaged, to confirm that the fluid entered the vacuum space from the outside, and to remove the entering fluid.

4. The long-life non-contact pump of claim 1, further comprising, on a part of the pump cylinder, a temperature sensor configured to sense a temperature of the fluid flowing in/out of the pumping space by pumping of the bellows.

5. The long-life non-contact pump of claim 1, further comprising on a part of the pump cylinder, a pressure sensor configured to sense a pressure of the fluid flowing in/out of the pumping space by pumping of the bellows.

* * * * *